US006067032A

United States Patent [19]

Anderson, Jr. et al.

[11] Patent Number: 6,067,032

[45] Date of Patent: May 23, 2000

[54] METHOD OF DETECTING STALLS IN A GAS TURBINE ENGINE

[75] Inventors: Gilbert L. Anderson, Jr., Royal Palm Beach; Damon K. Brown, West Palm Beach; Bruce S. Hinton, Wellington; James B. Kelly, Lake Worth, all of Fla.

[73] Assignee: United Technologies Corporation, Hartford, Conn.

[21] Appl. No.: 08/996,793

[22] Filed: Dec. 23, 1997

[51] Int. Cl.[7] ..... G08B 23/00

[52] U.S. Cl. ..... 340/966; 73/116; 244/1 R; 340/963; 701/100

[58] Field of Search ..... 340/945, 963, 340/966; 701/9, 14, 100; 244/1 R; 60/39.091; 73/116, 117.3, 117.4

[56] References Cited

U.S. PATENT DOCUMENTS

| | | | |
|---|---|---|---|
| 3,426,322 | 2/1969 | Balo | 340/966 |
| 3,867,717 | 2/1975 | Moehring et al. | 340/966 |
| 4,029,966 | 6/1977 | Baker et al. | 250/372 |
| 4,546,353 | 10/1985 | Stockton | 340/945 |
| 5,828,797 | 10/1998 | Minott et al. | 385/12 |

*Primary Examiner*—Brent A. Swarthout
*Attorney, Agent, or Firm*—Christopher T. Hayes

[57] ABSTRACT

The present invention provides a method of detecting an engine stall based on the intensity of ultraviolet light being sensed in the augmentor. The method is used to confirm a stall when the gas generator burner pressure sensor is operating properly, and as a back-up detection method when the burner pressure sensor fails, or when the burner pressure line to the control system ruptures and fails.

6 Claims, 4 Drawing Sheets

METHOD OF DETECTING STALLS IN A GAS TURBINE ENGINE

This invention was made under a U.S. Government contract and the Government has rights herein.

DESCRIPTION

1. Technical Field

This invention relates to aircraft engines of the turbine type of power plant and particularly to a method of detecting engine stalls in such power plants in aircraft.

2. Background Art

This invention is particularly concerned with military aircraft as opposed to civilian or commercial aircraft and even more particularly to the class of aircraft that would fall in the fighter class. Because of the nature of its flight mission this class of aircraft typically undergoes rather violent maneuvers, calling for much manipulation of the power lever to change thrust of the engine so as to accelerate and decelerate at very severe conditions. This type of operating condition can cause the engine's compression system to experience a stall condition that decreases engine airflow and thrust, and may require an engine restart to clear.

The conventional method of detecting aircraft turbofan compression system stalls is based on detection of rapid gas generator burner pressure decay. That method results in false detection when the burner pressure sensor fails, or when the burner pressure line to the control system ruptures and fails. Therefore, a requirement exists for an additional means of stall detection.

What is needed is a method of detecting a stall in a gas turbine engine when the burner pressure sensor fails, or when the burner pressure line to the control system ruptures and fails.

SUMMARY OF THE INVENTION

It is therefore an object of the present invention to provide a method of detecting a stall in a gas turbine engine when the burner pressure sensor fails, or when the burner pressure line to the control system ruptures and fails.

Accordingly the present invention provides a method of detecting an engine stall based on the intensity of ultraviolet light being sensed in the augmentor. The method is used to confirm a stall when the gas generator burner pressure sensor is operating properly, and as a back-up detection method when the burner pressure sensor fails, or when the burner pressure line to the control system ruptures and fails.

The foregoing and other features and advantages of the present invention will become more apparent from the following description and accompanying drawings.

BRIEF DESCRIPTION OF DRAWINGS

FIG. 8 is a graph showing the effect of an engine stall on gas generator burner pressure when the engine augmentor is on.

FIG. 9 is a graph showing the effect of an engine stall on ultraviolet light detected in the augmentor when the augmentor is on.

BEST MODE FOR CARRYING OUT THE INVENTION

Figure 1:
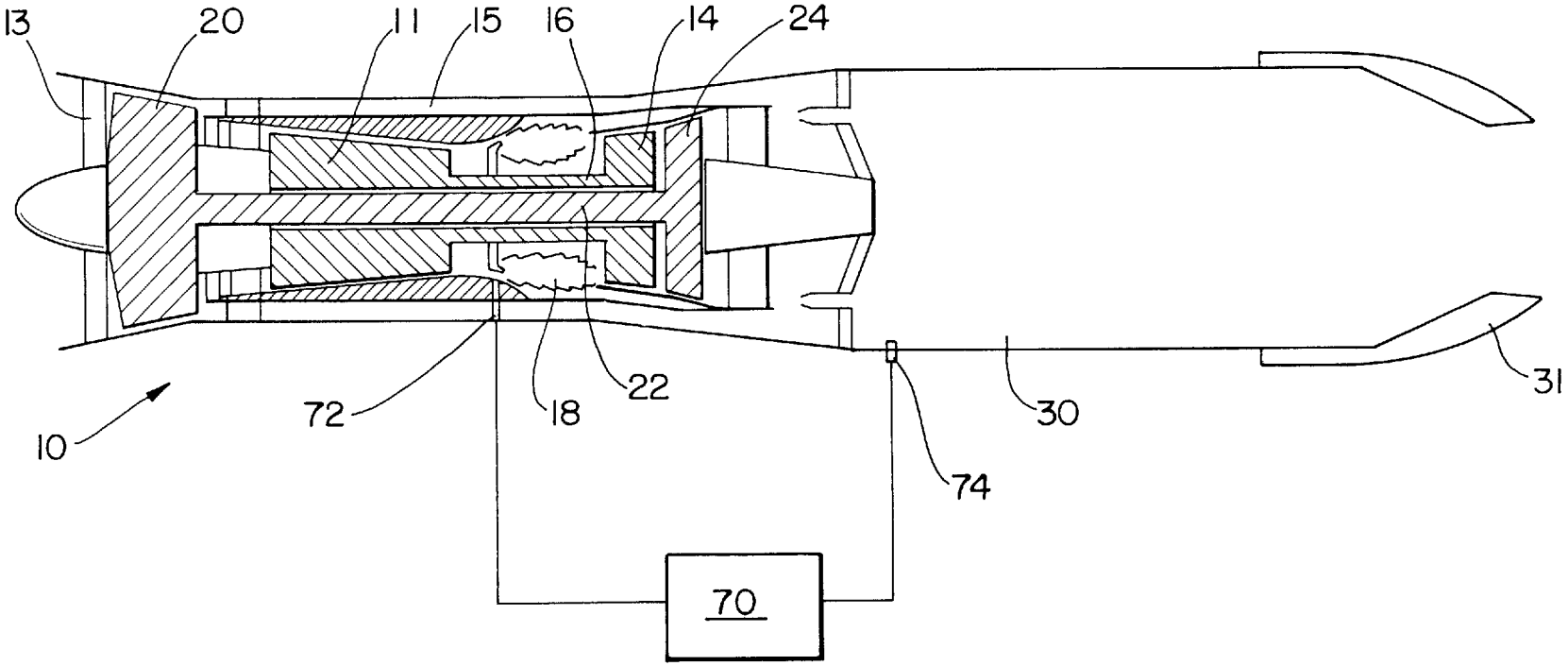
FIG. 1 is a plan view representing a typical gas turbine power plant and a schematic in block diagram illustrating the function of the engine control with respect to the gas generator burner pressure sensor and the augmentor light-off detector.

As is shown schematically in FIG. 1, the gas turbine power plant generally indicated by reference numeral 10 comprises an engine inlet 13, a gas generator section including a high pressure compressor 11 in spaced relation to a high pressure turbine 14, and the high pressure compressor 11 and the high pressure turbine 14 are interconnected by a high speed shaft 16. A gas generator burner 18 is disposed therebetween and serves to combust fuel to energize the engine's working medium. The fan and low pressure compressor 20 is in spaced relation to the low pressure turbine 24, and the fan and low pressure compressor 20 is connected to the low pressure turbine 24 by a low speed shaft 22. As used herein, the term "turbine section" refers collectively to the high pressure turbine 14 and the low pressure turbine 24. The high pressure compressor 11 and the high pressure turbine 14 are disposed between the low pressure compressor 20 and the low pressure turbine 24. The high pressure spool and low pressure spool are located between the inlet 13 and the augmentor 30. The low pressure spool and the high pressure spool are not mechanically connected to each other but rotate independently.

The engine also includes a bypass duct 15, and an augmentor 30 that receives the engine's working medium discharging from the low turbine section. The augmentor 30 is located downstream of the low pressure turbine 24, between the low pressure turbine 24 and the exhaust nozzle 31. Ultimately, the engine's working medium is discharged from the engine through the variable area exhaust nozzle 31. The low pressure compressor 20 draws air through the inlet 13 and supplies a first portion of the air to the bypass duct 15 and a second portion of the air to the high pressure compressor 11. As shown in FIG. 1, the bypass duct 15 is located radially outward from the high pressure compressor 11, the burner 18, the high pressure turbine 14 and the low pressure turbine 24 and serves to bypass a portion of air around the high pressure compressor 11, the burner 18, the high pressure turbine 14 and the low pressure turbine 24, and directly to the augmentor 30.

Fuel flow to the burner 18 is controlled by an engine control 70, preferably of the digital electronic type. The engine control 70 monitors a plurality of engine operating parameters and calculates values to adjust the fuel flow and engine's variable geometry to achieve optimum engine operation. Two of those parameters that are of importance to the present invention include the gas generator burner pressure, Pb, and the light-off detector, LOD 74. A burner pressure sensor 72 sends a first stream of data to the engine control during engine operation which the control uses to maintain the burner pressure within a predetermined operating range, and to trigger an engine stall warning alarm if the burner pressure falls outside of that range. An ultraviolet light detector, LOD 74 senses intensity of ultraviolet light in the augmentor 30 and sends a second stream of data to the engine control. Some gas turbine engines of the prior art currently use the information in the second stream of data to determine when the augmentor 30 has ignited, or is "on", since the intensity of ultraviolet light increases substantially when the augmentor 30 goes from its "off" condition, at which no combustion is taking place in the augmentor 30, to its "on" condition.

Figure 2:
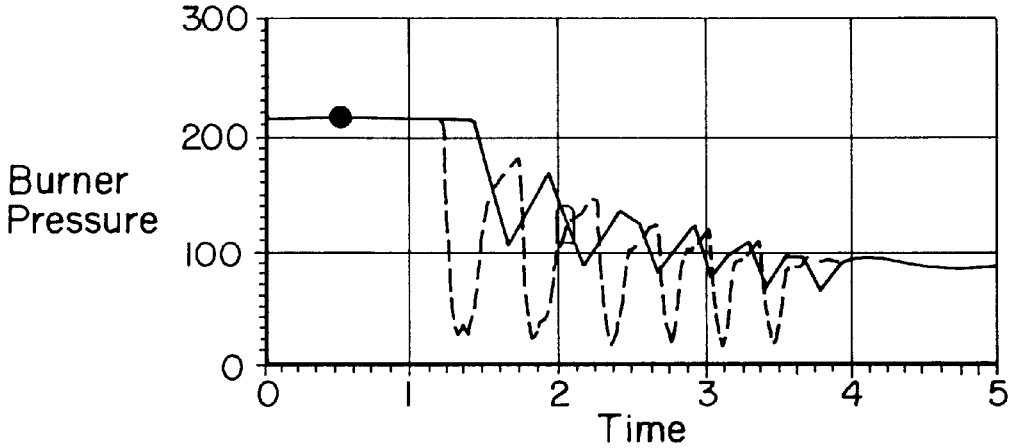
FIG. 2 is a graph showing the effect of an engine stall on gas generator burner pressure when the engine augmentor is off.
Figure 3:
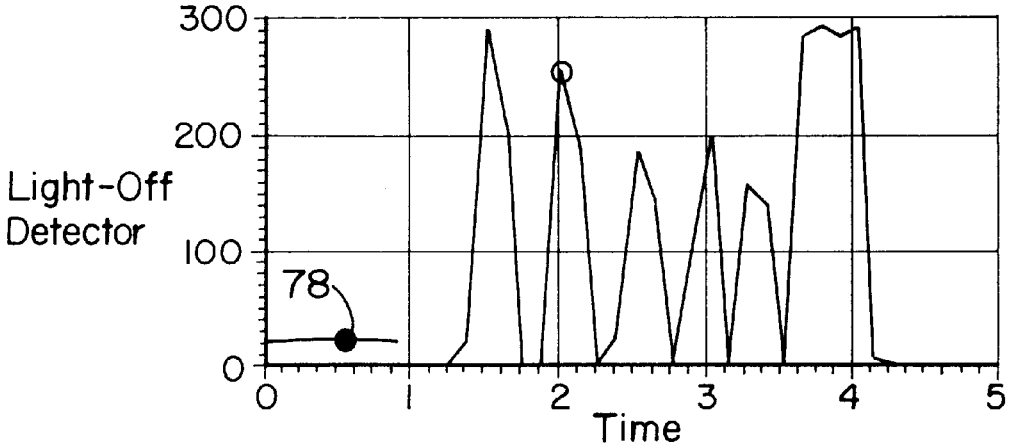
FIG. 3 is a graph showing the effect of an engine stall on ultraviolet light detected in the augmentor when the augmentor is off.
Figure 4:
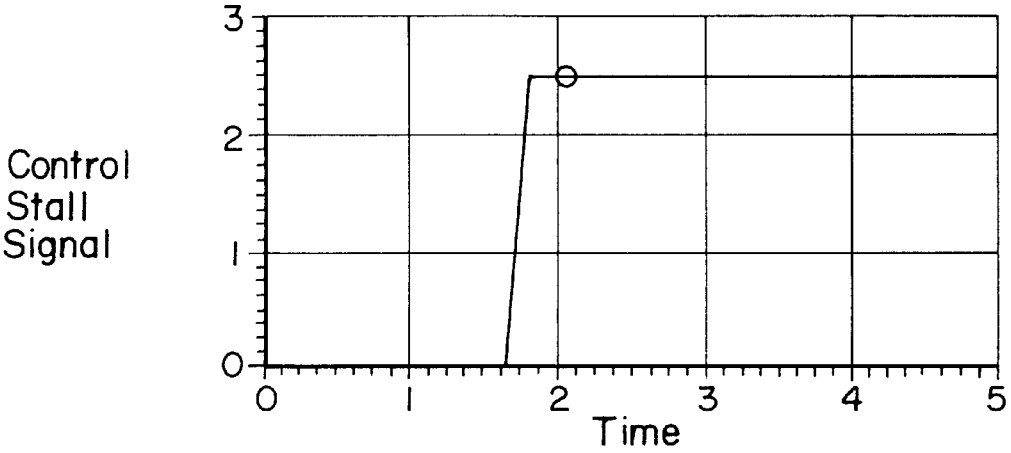
FIG. 4 is a graph showing the activation of an engine stall warning alarm.
Figure 5:
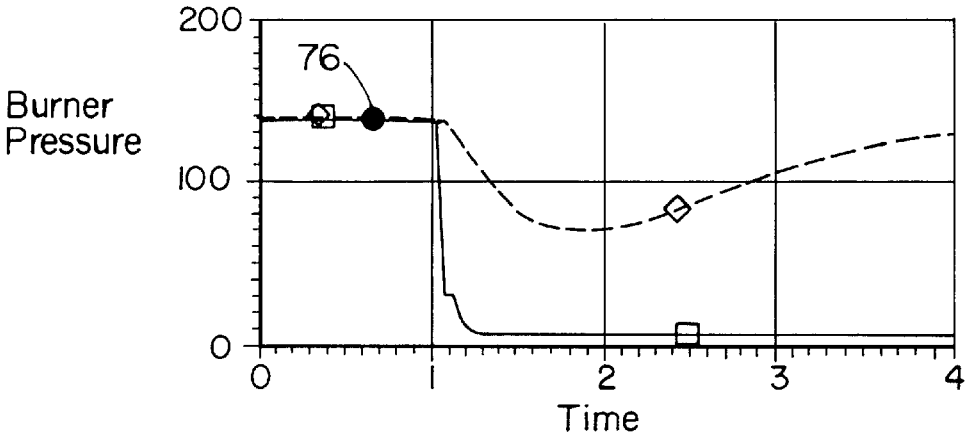
FIG. 5 is a graph showing the effect of a gas generator pressure sensor failure when the engine has not stalled and the engine augmentor is off.
Figure 6:
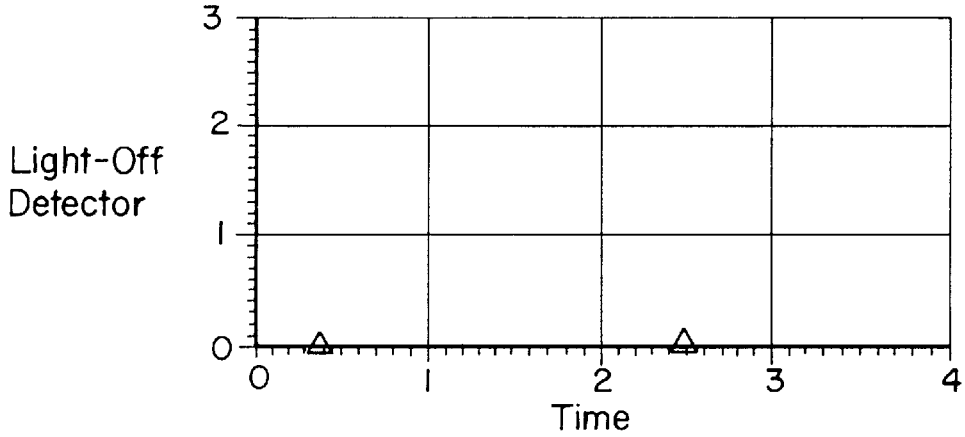
FIG. 6 is a graph showing the effect on ultraviolet light detected in the augmentor when the gas generator pressure sensor fails while the engine augmentor is off.
Figure 7:
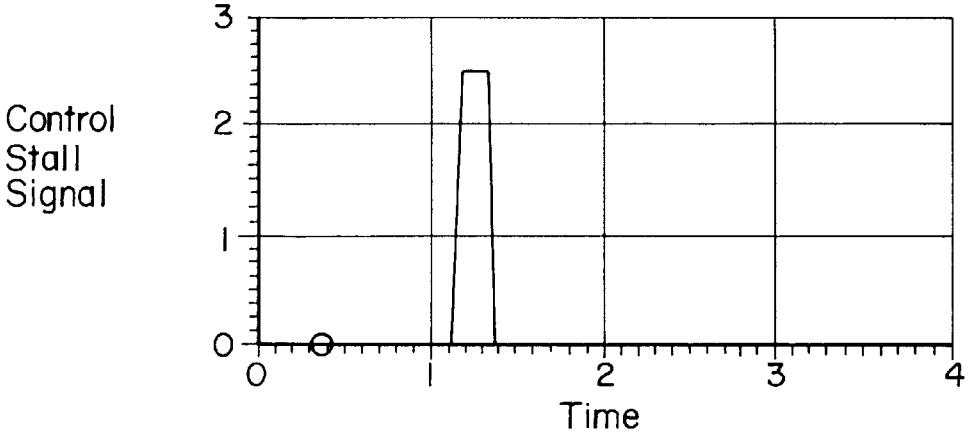
FIG. 7 is a graph showing the activation and deactivation of an engine stall warning alarm.
Figure 8:
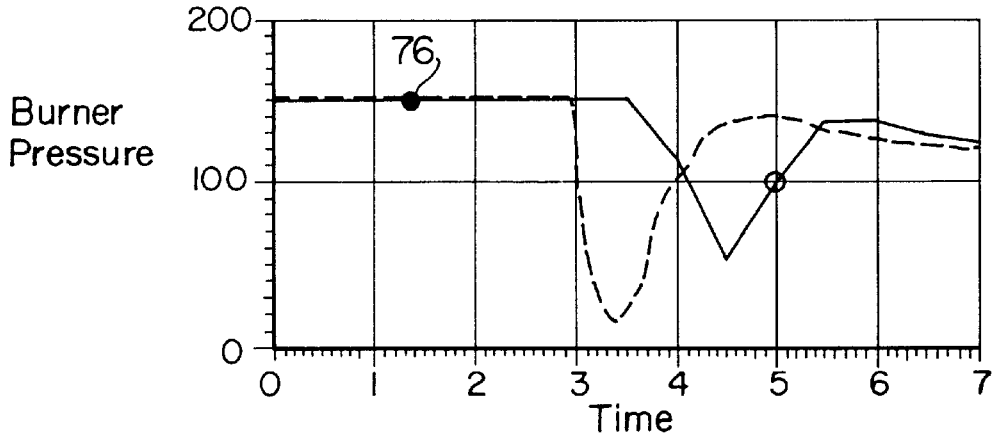
Figure 9:
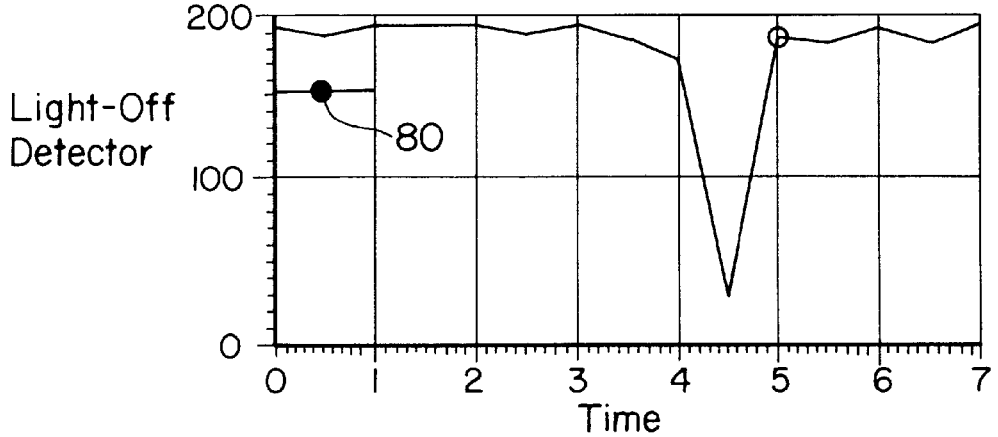
Figure 10:
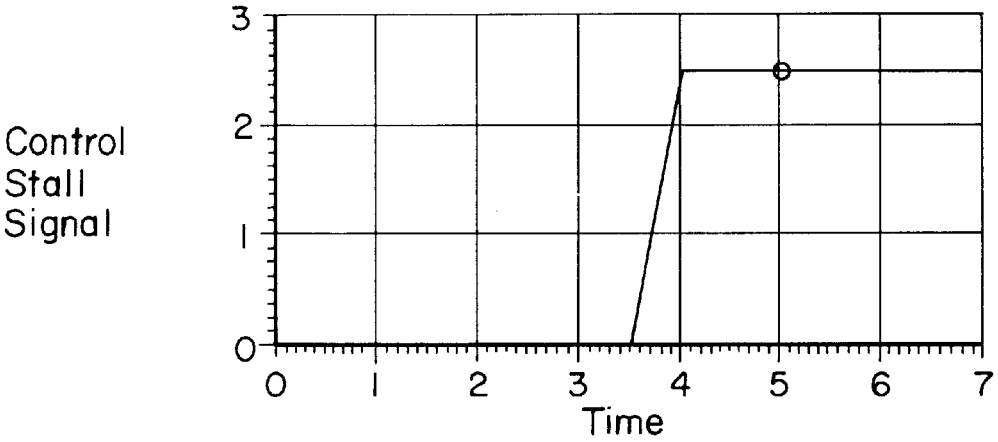
FIG. 10 is a graph showing the activation of an engine stall warning alarm.

The method of the present invention for determining when to activate an engine stall warning alarm includes monitoring the first stream of data to determine whether an engine stall has occurred as is done in the prior art, but does not trigger the engine stall warning alarm unless the second stream of data also indicates that an engine stall has occurred. As shown in FIG. 2, a typical stall is indicated when the burner pressure decays, in a somewhat sinusoidal fashion, from the burner pressure 76 that the engine control expects to observe at a given engine operating condition. (It is to be noted that the burner pressure, time and other parameters shown in FIGS. 2–10 are shown in nondimensionalized units for reference purposes only, and are not intended to be construed as actual engine data. However, the same first period of time is represented in FIGS. 2–4, the same second period of time is represented in FIGS. 5–7, and the same third period of time is represented in FIGS. 8–10.) When the engine control 70 identifies that first stream of data, which is of the sort shown in FIG. 2, indicates that an engine stall has occurred, the engine control also identifies if the second stream of data, from the LOD, indicates if engine stall has occurred. The particular method for determining from the second stream of data whether an engine stall has occurred depends on whether the augmentor 30 is on or off.

If the augmentor 30 is off, the LOD 74 normally indicates only negligible ultraviolet light intensity, since little or no combustion is taking place in the augmentor 30. However, since airflow reduction during an engine stall results in a fuel-rich gas generator burner 18, incomplete combustion in the gas generator burner 18 allows unburned fuel to pass through the turbine section 14, 24 to the augmentor 30, and into the field of view of the LOD 74. The intensity of ultraviolet light detected in the augmentor 30 momentarily increases when the fuel-laden air from the gas generator burner 18 comes in contact with the supply of fan air in the augmentor 30 and momentarily burns, as shown in FIG. 3. These momentary increases and decreases in the intensity of ultraviolet light repeat as airflow through the gas generator burner 18 fluctuates during a stall, and causes the ultraviolet light in the augmentor 30 to exceed a maximum predetermined value 78 which is not normally exceeded when the augmentor 30 is off.

If both the first and second streams of data indicate that an engine stall has occurred, the engine control activates the stall warning alarm, as shown in FIG. 4. However, as shown in FIG. 5, if the engine is operating normally and the first stream of data indicates that an engine stall has occurred, which can happen if the burner pressure sensor 72 fails (or the burner pressure sensor line develops a leak), the LOD 74 will not detect an increase in the ultraviolet intensity, as shown in FIG. 6, since combustion in the gas generator burner will be essentially complete and therefore there will be no fuel to combust in the augmentor 30. Thus, as shown in FIG. 7, an initial control stall signal will be aborted as a result of the LOD data, and false stall detection from these causes can be avoided. Additionally, if the burner pressure sensor 72 is known to have failed and an engine stall occurs, a stall can be detected based solely on the second stream of data from the LOD 74.

If the augmentor 30 is on (i.e. the augmentor 30 is lit) when a stall occurs, the method of detecting a stall with the LOD 74 stream of data is slightly different from that described above. FIG. 8, which is similar to FIG. 2, shows how the first stream of data, indicating burner pressure, decays when a stall occurs. When the engine control 70 identifies that first stream of data indicates that an engine stall has occurred, the engine control 70 again identifies if the second stream of data from the LOD 74 also indicates that an engine stall has occurred. But as shown in FIG. 9, since substantial combustion is occurring in the augmentor 30, the intensity of ultraviolet light detected by the LOD 74 is no longer negligible. (This second stream of data is the mechanism by which the engine control 70 identifies that the augmentor 30 is on and lit, and it is for this purpose that LOD's were originally incorporated into the augmentors of certain gas turbine engines.) However, since the airflow reduction that occurs during an engine stall reduces total airflow through the augmentor 30, the inventors believe that an engine stall during augmented engine operation produces locally high fuel/air ratios that result in incomplete combustion in the augmentor 30. This, in turn, results in a lower intensity of ultraviolet light being detected in the augmentor 30 by the LOD 74, as shown in FIG. 9. The intensity of ultraviolet light detected in the augmentor 30 momentarily decreases when the augmentor 30 becomes too fuel rich, and the intensity indicated by the second stream of data drops below a minimum predetermined value 80 when the augmentor 30 is on.

If both the first and second streams of data indicate that an engine stall has occurred when the augmentor 30 is on, the engine control activates the stall warning alarm, as shown in FIG. 10. However, if the engine is operating normally and the first stream of data indicates that an engine stall has occurred, as can happen if the burner pressure sensor 72 fails or the burner pressure line develops a leak, the LOD 74 will not detect a decrease in the ultraviolet intensity below the minimum predetermined value 80 in the second stream of data since combustion in the augmentor 30 will be essentially complete and therefore there will be no over-fueling of the augmentor 30 to cause combustion to decrease. Thus, false stall detection from these causes can be avoided. As described above, if the burner pressure sensor 72 is known to have failed and an engine stall occurs, a stall can be detected based solely on the second stream of data from the LOD 74 by determining whether the intensity of ultraviolet light falls below the minimum predetermined value 80.

Although this invention has been shown and described with respect to detailed embodiments thereof, it will be understood by those skilled in the art that various changes in form and detail thereof may be made without departing from the spirit and scope of the claimed invention.

We claim:

1. A method for determining when to activate an engine stall warning alarm, said method comprising providing a gas turbine engine having an engine control for operating said engine, a gas generator burner, an exhaust nozzle in spaced relation to said gas generator burner, a turbine section disposed between said gas generator burner and said exhaust nozzle, a pressure sensor that senses pressure in said gas generator burner and sends a first stream of data to said control, and an ultraviolet light detector that senses intensity of ultraviolet light at a location between said turbine section and said exhaust nozzle and sends a second stream of data to said control, monitoring said first stream of data and said second stream of data during engine operation, identifying if said first stream of data indicates that an engine stall has occurred, identifying if said second stream of data indicates that an engine stall has occurred, activating said stall warning alarm only if both said first and second streams of data indicate that an engine stall has occurred.

2. The method of claim 1 wherein and said step of identifying if said second stream of data indicates that an engine stall has occurred includes detecting if said intensity of ultraviolet light exceeds a maximum predetermined value.

3. The method of claim 2 wherein said step of identifying if said second stream of data indicates that an engine stall has occurred includes detecting a series of increases and decreases in said intensity of ultraviolet light.

4. The method of claim 1 wherein said engine further comprises an augmentor located between said turbine section and said exhaust nozzle, and said step of identifying if said second stream of data indicates that an engine stall has occurred is preceded by the step of identifying if said second stream of data indicates that the engine augmentor is on.

5. The method of claim 4 wherein said ultraviolet light detector senses ultraviolet light produced in the augmentor, and said step of identifying if said second stream of data indicates that an engine stall has occurred includes detecting if said intensity of ultraviolet light exceeds a maximum predetermined value when said augmentor is off, and detecting if said intensity of ultraviolet light drops below a minimum predetermined value when said augmentor is on.

6. The method of claim 5 wherein said step of identifying if said second stream of data indicates that an engine stall has occurred includes detecting a series of increases and decreases in said intensity of ultraviolet light when said augmentor is off.

* * * * *